United States Patent [19]

Smith

[11] 4,299,381

[45] Nov. 10, 1981

[54] SHEET FEEDING APPARATUS

[75] Inventor: Richard E. Smith, Webster, N.Y.

[73] Assignee: Xerox Corporation, Stamford, Conn.

[21] Appl. No.: 174,776

[22] Filed: Aug. 4, 1980

[51] Int. Cl.[3] ..... B65H 3/12

[52] U.S. Cl. ..... 271/96; 271/35; 271/98; 271/99; 271/108

[58] Field of Search ..... 271/96, 97, 98, 99, 271/108, 35, 20, 94

[56] References Cited

U.S. PATENT DOCUMENTS 1,888,194 11/1932 Broadmeyer ..... 271/98

2,764,407 9/1956 Alix ..... 271/108

3,595,563 7/1971 Rostoker ..... 271/96

4,269,406 5/1981 Hamlin ..... 271/98 X

*Primary Examiner*—Richard A. Schacher

[57] ABSTRACT

A bottom sheet feeder employing a vacuum feed assembly in conjunction with an air knife for separating and feeding sheets from a sheet stack. A self regulating blower input and output bleed valve assembly utilized in conjunction with a single blower regulates air flow through the blower to the air knife irrespective of the degree of air flow through the vacuum feed assembly caused by blockage thereof by the acquired sheets.

3 Claims, 4 Drawing Figures

SHEET FEEDING APPARATUS

BACKGROUND OF THE INVENTION

With the advent of high speed xerographic copy reproduction machines wherein copies can be produced at a rate in excess of three thousand copies per hour, the need for a document handler to feed documents to the copy platen of the machine in a rapid, dependable matter was recognized to enable full utilization of the reproduction machines potential copy output. A number of document handlers are currently available to fill that need. These document handlers must operate flawlessly to virtually eliminate the risk of damaging the originals and generate minimum machine shutdowns due to uncorrectable misfeeds or document multifeeds. It is in the initial separation of the individual documents from the document stack where the greatest number of problems occur.

To provide a gentle yet positive feed, a vacuum feed belt assembly may be positioned beneath the stack of documents to be fed for acquiring the bottom document in the stack on the belts by vacuum and energizing the belts to pull the acquired document from under the stack into the document path of the document handler. To prevent misfeeds and multifeeds, an air knife may be positioned at the lead edge of the stack for injecting air between the documents in the stack to provide an air bearing between the document being fed and the remainder of the stack. This greatly reduces the force necessary to pull the bottom document from the stack and also minimizes the possibility of the adjacent document being pulled out from under the stack with the document being fed.

To simplify the feed system, a single blower may be used to provide both positive and negative air pressure for the air knife and vacuum feed belt assembly respectively.

However, if the sheet being fed is tightly drawn onto the vacuum feed belt assembly, the sheet will substantially block the flow of air to the inlet of the blower, thereby reducing the flow of air to the air knife below the level required to adequately lift the document stack and provide an air bearing between the sheet being fed and the remainder of the sheets in the stack.

Conversely, prior to a sheet being pulled down onto the vacuum feed belt assembly, air flow to the blower may be essentially unrestricted, resulting in excess air flow to the air knife. It is therefore the object of this invention to provide a sheet feeder having an automatic self compensating air flow control valve to provide the desired air flow through the system at all times.

SUMMARY OF THE INVENTION

A sheet feeder for separating and feeding the bottom sheet in a sheet stack, including a plurality of vacuum feed belts spaced below the surface of the sheet stack tray, positive air pressure means being provided for air flotation of the stack to reduce the weight of the stack on the bottom sheet thereof. A single blower is utilized to provide the sub-atmospheric pressure for the vacuum feed means and the air supply for air flotation. To provide optimum air flow in the system, a self actuating vacuum-pressure bleed valve is interconnected with the blower inlet and outlet.

DESCRIPTION OF THE PREFERRED EMBODIMENT

Figure 1:
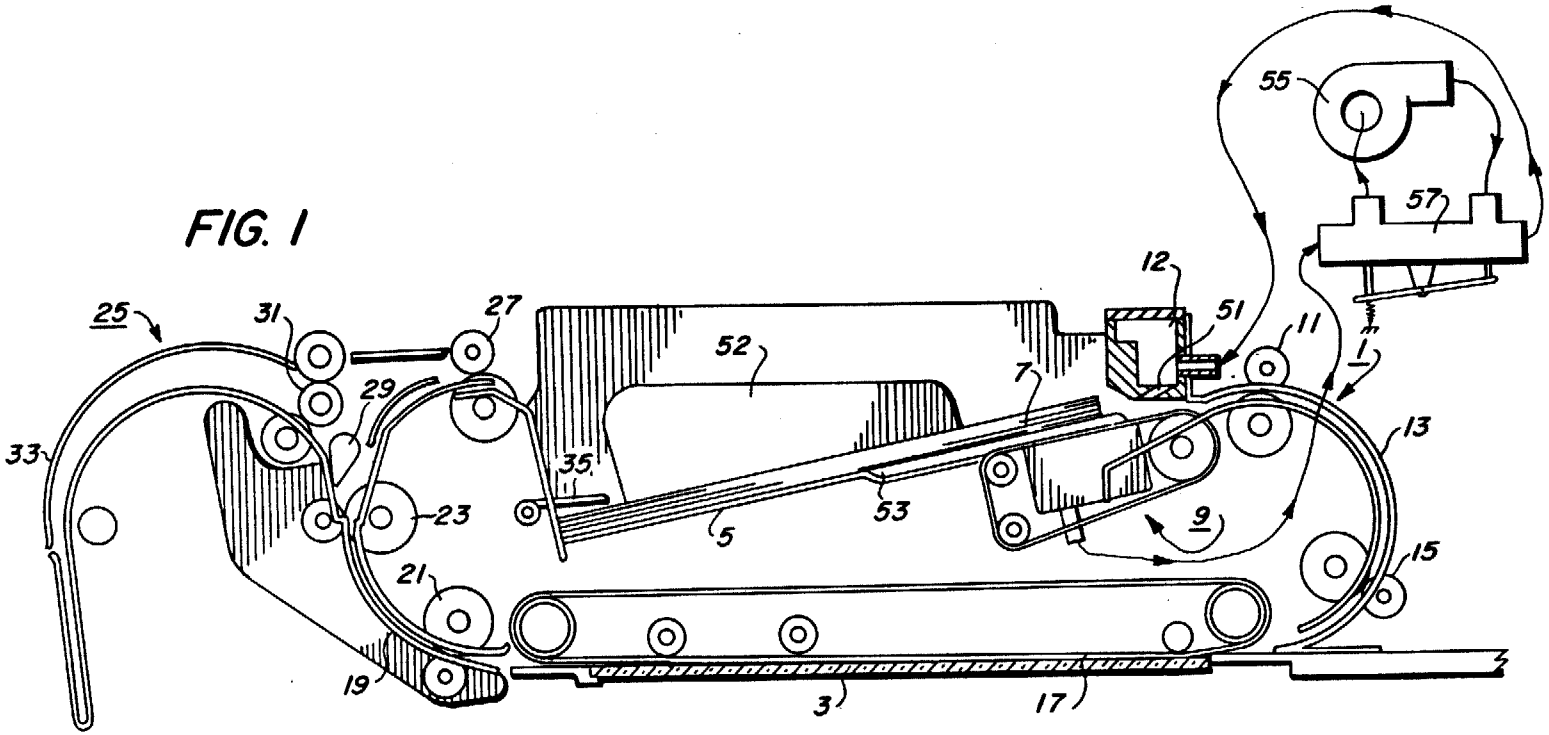
FIG. 1 is a cross-sectional view of an exemplary document handler employing the sheet feeder of the present invention.

Referring to the drawings, there is illustrated an automatic document handler 1 for installation above the exposure platen 3 of a xerographic reproduction machine. The document handler is provided with a document tray 5 to be explained more fully hereinafter, adapted for supporting a stack of documents 7 face up. A vacuum belt-corrugating feeder mechanism 9 is located below the document tray for acquiring and corrugating the bottom document in the stack and forwarding the document to take away roll pair 11 after an air knife 12 has had time to separate sheet 1 from the rest of the stack. The document is then fed by take-away roll pair 11 through document guide 13 to feed-roll pair 15 and under platen belt 17 onto the platen of the copy machine for reproduction. After exposure of the document, it is fed off the platen by belt 17 into guide 19 and feed-roll pairs 21 and 23 either to an inverter mechanism 25 or back to the document stack through the feed-roll pair 27. A diverter 29 is provided to divert the document either to the inverter or to the feed roll pair 27. The inverter comprises a three roll arrangement 31 and a closed inverter pocket 33. If the document is to be inverted it is fed through the lower two rolls of the three roll inverter into the pocket. When the trail edge of the document clears the nip of the lower two rolls in the three roll inverter, the stiffness of the sheet will cause the trail edge to straighten up into the nip of the upper two rolls of the inverter at which time it will be fed into roll pair 27 and back into the document stack. The inverter pocket illustrated is sized such that when the leading edge of the document contacts the end of the pocket, the document will buckle slightly within the upper portion of the pocket 33, the buckle thereby providing the required force to feed the trailing edge of the document into the upper roll pair of the inverter rolls for feeding the sheet toward roll pair 27. If desired, an open ended inverter pocket could be utilized having a feed roll pair associated therewith for feeding the document back into the upper roll pair in a positive manner rather than relying on the sheet buckle to feed the document thereto.

The document handler is also provided with a sheet separator finger 35 as is well known in the art to separate the documents to be fed from those documents returned to the document handler. Upon removal of the last document from beneath sheet separator finger 35, the finger 35 drops through a slot provided in the tray, suitable sensors are provided to sense that the last document in the set has been removed from the tray and the finger is then rotated in a clockwise direction to again come to rest on the top of the documents in the stack prior to subsequent recirculation of the document set.

Figure 2:
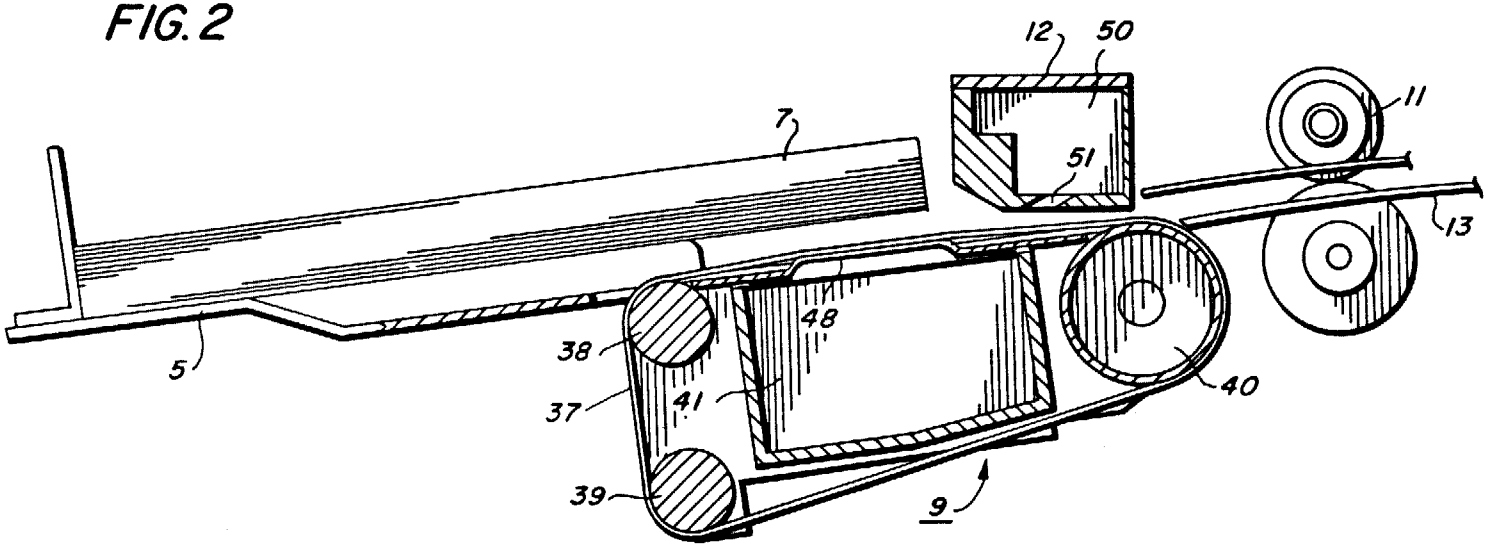
FIG. 2 is an enlarged, cross-sectional view of the separator-feeder portion of the document handler of FIG. 1.
Figure 3:
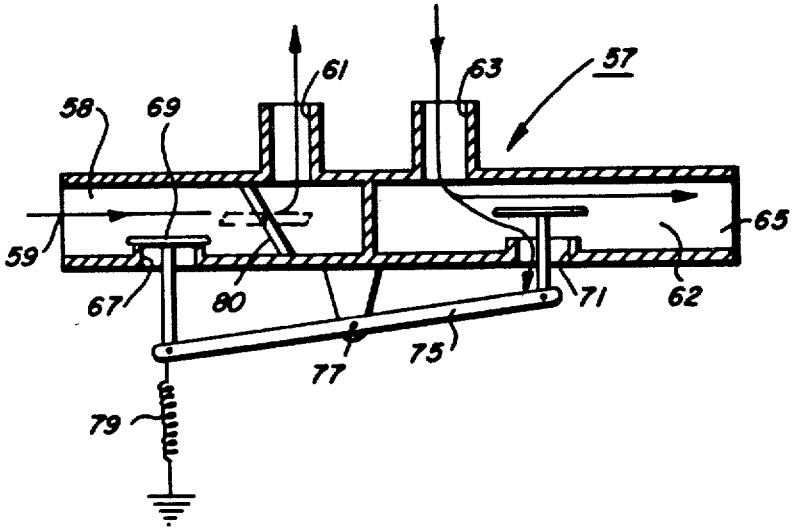
FIG. 3 is a sectional view of the vacuum-pressure bleed valve illustrated schematically in FIG. 1.
Figure 4:
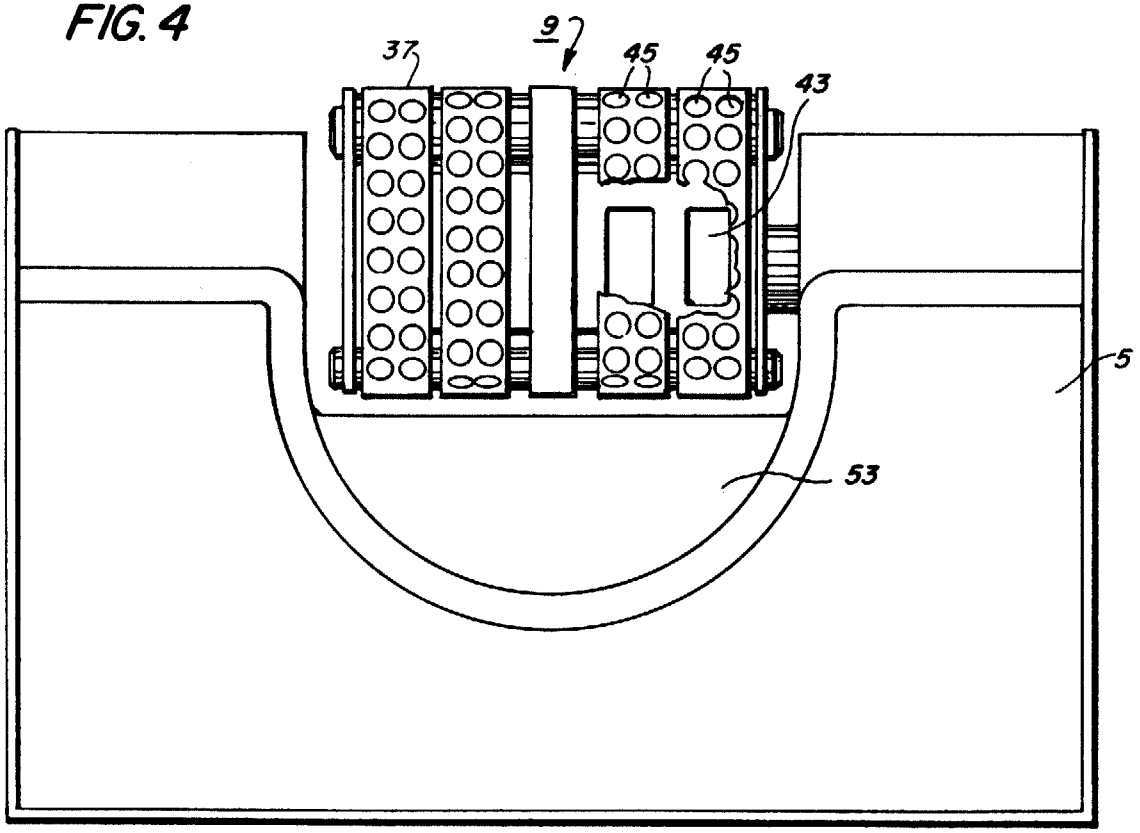
FIG. 4 is a top view of the document tray and feed belts of the document handler illustrated in FIG. 1.

Referring more particularly to FIGS. 2, 3 and 4 wherein the sheet separator-feeder is more clearly illustrated, there is disclosed a plurality of feed belts 37 supported for movement on feed belt rolls 38, 39, and 40. Spaced within the run of the belts 37 there is provided a vacuum plenum 41 having openings 43 therein adapted for cooperation with perforations 45 in the belts 37 to provide a vacuum for pulling the bottom document in the document stack onto the belts 37. The belts are located below the surrounding support surface so that the sheet being fed is pulled down from the bottom of the sheet stack. The gap formed between sheets one and two provide for entry of the separating air flow from the air knife 12. The air knife 12, comprised of pressurized air plenum 50 having a plurality of air jet openings 51, is provided to inject air into the pocket formed between the document pulled down against the feed belt and the documents thereabove to provide an air cushion or bearing between the stack and the bottom document to minimize the force necessary for removing the bottom document from the stack.

By suitable valving and controls (not shown), a delay may be provided between the time the vacuum is applied to pull the document onto the belts and the start up of the feed belts to assure that the bottom document is captured on the belt before belt movement commences and to allow time for the air knife to separate sheet 1 from any sheets that were pulled down with it.

By reference to FIGS. 1, 2 and 4 it can be seen that the document tray 5 is provided with a depressed portion or pocket 53 behind the feed belt assembly. This pocket serves a number of purposes. First, space is provided for the forward portion of the bottom document to be pulled down onto the feed belt assembly as previously mentioned. When the bottom document is pulled into this space, an envelope type opening or pocket is created between the bottom sheet and the remainder of the sheets in the stack. Air injected into this space from the air knife produces an air bearing between the bottom sheet and the remainder of the stack to allow easy removal of the bottom sheet from beneath the stack. Flow of air from the pocket is restricted by the partial seal or flow restricton caused by supporting the major portion of the stack weight on the edge portions of the tray surrounding the pocket.

To further increase the efficiency of the system, the stack tray is provided with a rearward tilt as seen in FIGS. 1 and 2. When flotation air is provided under the stack or between the first and second sheets, gravity will allow the sheets to settle or float back against the rear tray wall. Thus, the sheet being removed is pulled uphill while gravity helps hold the remainder of the sheets back, helping to prevent multifeeds.

By reference to FIG. 1, it can be seen that a single blower unit 55 is utilized to provide sub-atmospheric pressure in plenum 41 and pressurized air to air knife 12. The air flow through blower 55 is partially controlled by the actual operation of the feeder in that when a sheet is acquired on the vacuum belts, a restriction of air flow to the blower is caused by the sheet, thereby reducing the output of air supplied to the air knife. Thus in certain circumstances, depending upon the paper weight and therefore the ability of the sheet being fed to conform to the apertures in the feed belt assembly vacuum plenum, the sheet being fed acts as a control valve for the system. However, further control of the air flow through the system may be desirable. Therefore, a control valve 57, best illustrated in FIG. 3 is provided to assure adequate air flow to the air knife under circumstances where the sheet being fed substantially blocks off flow of air to the blower and also to prevent excessive air flow to the air knife prior to sheet acquisition on the feed belts.

By reference to FIG. 3, it can be seen that a two chambered valve assembly is provided, the first chamber 58 having an inlet 59 communicating with the vacuum feed belt assembly plenum and an outlet 61 for communication with the inlet to the blower 55. The valve assembly is also provided with a second chamber 62 having an inlet 63 for communication with the output side of blower 55 and an output port 65 for communication with the air knife plenum. A vacuum bleed port 67 having a cooperating valve 69, and a pressurized bleed port 71 having a valve 73 associated therewith are interconnected by a lever arm 75 for reasons to be hereinafter explained. The lever arm 75 is pivoted at 77 and biased in a counterclockwise direction by suitable means such as spring 79.

Under conditions wherein very little air blockage is encountered at the vacuum feed belt assembly, air flow into port 59 through port 61 to the inlet of the blower will be at a level such that minimum vacuum will be produced within chamber 58. Valve 69 will therefore remain closed as illustrated which will result in valve 73 being open to bleed some of the air flow from the output of blower 55 to prevent excessive air discharge from air knife 12 and minimize sheet blow away in the sheet stack which could result from unrestricted flow of air through the blower.

In the event that the air apertures in the vacuum feed belt assembly are substantially blocked by a sheet closely conforming to the top surface of the feed belt assembly, and minimum air flow is provided to the inlet of the blower and therefore to the air knife, the vacuum produced in chamber 58 will cause valve 69 to be pulled up by the reduced pressure. This will allow flow of air into chamber 58 to increase the flow of air through blower 55. When valve 69 opens, valve 73 which is interconnected thereto through lever 75 will close, thereby preventing the bleed of air from the output of the blower to provide the entire blower output to the air knife. If should be understood that under certain circumstances, both valves 69 and 73 will be positioned somewhere between fully open and fully closed due to the variation in input and output pressures of the blower. Utilizing this valve, the input and output of blower 55 is closely controlled to provide optimum vacuum for the feed belt assembly and optimum air flow for the air knife without extensive adjustments or controls. Thus the sheet feeder is capable of handling a wide variety of sheet weights and stiffness due to the control exerted on the system by the automatic air flow control valve 57. The valve 57 is also provided with an air shut off valve plate 80. With the disclosed system, the blower is operated continuously and air flow to the blower is controlled by opening and closing valve plate 80. At the start of the feed cycle, the valve plate is opened, allowing air flow through the system to provide the required vacuum and high pressure air for the air knife. After the bottom sheet has been fed, the valve plate 80 is closed to allow return of the previously exposed sheet to the tray without interference from the air knife flow.

It can be seen from the forgoing that an efficient, gentle yet positive bottom sheet feeder is provided through the use of the disclosed control valve, the air flow through the vacuum transport is maximized while the air flow through the air knife is minimized prior to sheet acquisition on the feed belts. Further, the valve maximizes air flow through the air knife and compensates for reduced air flow through the vacuum transport following sheet acquisition.

While I have described the preferred embodiment of my invention, it is to be understood that the invention is not limited thereto but may be otherwise embodied within the scope of the following claims.

I claim:

1. A bottom sheet separator-feeder for separating and forwarding sheets seriatim comprising;

a stack tray adapted for supporting a stack of sheets, vacuum sheet feed means associated with said tray located in a position spaced from the bottom sheet in the stack, air injection means adapted to provide a layer of air between said tray and the bottom sheet in the stack in between the bottom sheet and the remainder of the sheets in the stack, single blower means associated with said vacuum feed means and said air injection means to provide negative air pressure for said vacuum feed means and positive air pressure for said air injection means; and, valve means associated with the inlet and the outlet of said blower means, said valve means being adapted to bleed air into the blower inlet when the air flow to the blower is reduced due to blockage of air through the vacuum sheet feed means upon acquisition of a sheet thereby, said valve means being adapted to bleed air from the output of said blower to prevent excessive air flow to said air injection means when the air flow through said vacuum sheet feed means to said blower is substantially unrestricted.

2. A bottom sheet separator-feeder according to claim 1 wherein said valve means comprises a two chambered valve housing, one of said chambers being interposed between said vacuum sheet feed means and the inlet to said blower, the other of said chambers being interposed between the outlet of said blower and said air injection means, each of said chambers having a bleed port associated therewith, a bleed valve associated with each of said bleed ports, said bleed valves being interconnected such that when one of said bleed valves is in a fully open position to allow flow of air through its associated bleed port, the other of said bleed valves is positioned to completely block the flow of air through its associated bleed port.

3. A bottom sheet separator-feeder according to claim 2 wherein said valves are interconnected by a pivoting lever, and biasing means biasing said lever in a direction to bias the valve in the valve chamber associated with the inlet of said blower toward a closed position.

* * * * *